US011390980B2

(12) United States Patent
Morandini

(10) Patent No.: US 11,390,980 B2
(45) Date of Patent: Jul. 19, 2022

(54) DRAWER FOR LAUNDRY APPLIANCE

(71) Applicant: Electrolux Appliances Aktiebolag, Stockholm (SE)

(72) Inventor: Stefano Morandini, Porcia (IT)

(73) Assignee: Electrolux Appliances Aktiebolag

( * ) Notice: Subject to any disclaimer, the term of this patent is extended or adjusted under 35 U.S.C. 154(b) by 0 days.

(21) Appl. No.: 17/265,308

(22) PCT Filed: Aug. 23, 2019

(86) PCT No.: PCT/EP2019/072618
§ 371 (c)(1),
(2) Date: Feb. 2, 2021

(87) PCT Pub. No.: WO2020/043625
PCT Pub. Date: Mar. 5, 2020

(65) Prior Publication Data

US 2021/0301452 A1 Sep. 30, 2021

(30) Foreign Application Priority Data

Aug. 30, 2018 (EP) ..... 18191658

(51) Int. Cl.
*D06F 39/02* (2006.01)
*D06F 58/20* (2006.01)

(52) U.S. Cl.
CPC ..... *D06F 39/02* (2013.01); *D06F 58/20* (2013.01)

(58) Field of Classification Search
CPC ..... D06F 39/02
See application file for complete search history.

(56) References Cited

U.S. PATENT DOCUMENTS

2010/0000578 A1 1/2010 Hendrickson et al.

FOREIGN PATENT DOCUMENTS

| | | | |
|---|---|---|---|
| CN | 103485133 | A | 1/2014 |
| CN | 205839411 | U | 12/2016 |
| DE | 202006019468 | U1 | 2/2007 |
| EP | 2281938 | A1 | 2/2011 |
| ES | 2301316 | A1 | 6/2008 |

OTHER PUBLICATIONS

International Search Report and Written Opinion for International Application No. PCT/EP2019/072618, dated Oct. 21, 2019, 10 pages.

*Primary Examiner* — Jason Y Ko
(74) *Attorney, Agent, or Firm* — RatnerPrestia

(57) ABSTRACT

A laundry appliance having a cabinet accommodating a laundry treatment chamber and a storage drawer adapted to slide into the cabinet along a first direction. The storage drawer comprises a drawer body and a drawer handle. The drawer handle is connectable with the drawer body in a releasable way through a coupling arrangement. The coupling arrangement comprises drawer body sliding means arranged on the drawer body, and drawer handle sliding means arranged on the drawer handle and adapted to slidingly engage with the drawer body sliding means for allowing the drawer handle to move with respect to the drawer body. The drawer body and drawer handle sliding means extend along a second direction perpendicular to the first direction and parallel to a top surface of the cabinet so as to allow the drawer handle to be detached from the drawer body by a lateral movement along said second direction.

15 Claims, 10 Drawing Sheets

DRAWER FOR LAUNDRY APPLIANCE

This application is a U.S. National Phase application of PCT International Application No. PCT/EP2019/072618, filed Aug. 23, 2019, which claims the benefit of European Application No. 18191658.6, filed Aug. 30, 2018, both of which are incorporated by reference herein.

BACKGROUND OF THE PRESENT INVENTION

Field of the Present Invention

The present invention generally relates to the field of laundry appliances, and particularly to appliances for treating, e.g., washing, rinsing, and/or drying items (such as linen, clothes, garments, and the like), such as laundry washing machines, laundry drying machines, and combined laundry washing and drying machines. Specifically, the present invention relates to a drawer for a laundry appliance.

Overview of the Related Art

As it is well known, laundry appliances comprise a laundry treatment chamber wherein items to be treated (e.g., washed, rinsed and/or dried) are placed to be subjected to various laundry treatment operations.

Making reference to a laundry washing machine (but similar considerations also apply to combined laundry washing and drying machines), such laundry treatment operations involve the use of detergent substances, in powder and/or in liquid form, and of possible additional substances, such as for example softening agents, and rinsing agents, which will be defined in the present description as a whole as "washing agents".

During some phases of laundry treatment operations, amounts of such washing agents should be delivered into the laundry treatment chamber in a controlled way. For this purpose, the laundry washing machine is equipped with a washing agents dispensing system comprising one or more washing agent containers adapted to be loaded with amounts of washing agents, and delivery devices for delivering into the laundry treatment chamber controlled amounts of the washing agents contained in the washing agent containers.

Making reference to a front-loading washing machine, the washing agent containers of the dispensing system are usually implemented as compartments of a drawer-shaped support structure, hereinafter simply referred to as dispensing drawer, which can be (at least partially) extracted from a front portion of the washing machine cabinet.

As it is well known to those skilled in the art, the compartments of the dispensing drawer can be configured to be loaded by a user with individual doses of washing agents, e.g., with an amount of washing agent necessary for a laundry treatment cycle on a single load of items, or may have a larger capacity sufficient to store more doses of washing agents, adapted to be used for more laundry treatment cycles on a plurality of loads of items.

Making reference instead to a laundry drying machine of the condensation type, the condensed (hence, liquid) moisture generated by the condensing of the process air has to be drained into a proper collection container. In this case as well, the container for collecting condensed moisture may be implemented as a compartment of a drawer-shaped support structure which can be manually extracted from the laundry drying machine and emptied by a user.

Therefore, in view of the above, a generic laundry appliance is usually equipped with a storage drawer (e.g., a dispensing drawer for dispensing washing agents into the laundry treatment chamber of a laundry washing machine or a drawer-shaped support structure for collecting condensed moisture of a laundry-drying machine of the condensation type) adapted to contain washing agents or condensed moisture which can be extracted/inserted from/into the laundry appliance cabinet along an extraction/insertion direction, usually perpendicular to the wall of the cabinet where the storage drawer is located. Such storage drawer is usually provided with a suitable handle designed to be used by an user for easily extracting/inserting the storage drawer from/into the cabinet of the laundry appliance.

If the storage drawer is not accurately cleaned from time to time, washing agent residuals and/or stagnant water may cause washing agent delivery devices to clog and/or bad smelling to generate.

For this reason, it is known to have storage drawers which are capable of being easily separated from the cabinet of the laundry appliance for being subjected to washing/rinsing operations. For example, a storage drawer may be completely pulled out and disengaged from the laundry appliance for being washed under a flow of fresh water, e.g., sourced by a faucet.

In order to easy the cleaning operations of the storage drawer and allow the latter to be cleaned in a more thoroughly way, the storage drawer should be advantageously designed to allow the detachment of the handle from the rest of the storage drawer (storage drawer body). Moreover, said detachment action for the drawer cleaning should be such to prevent the damage/wear of the handle.

For this reason, storage drawers exists which have the handle that is connectable with the storage drawer body (usually, with the front portion thereof) in a releasable way through a suitable coupling arrangement.

According to a solution known in the art, the handle is coupled with the storage drawer body through a coupling arrangement comprising tooth elements located on the internal side of the handle (i.e., the side of the handle facing the storage drawer body when the former is coupled with latter) and adapted to engage corresponding seats located on the front portion of the storage drawer body. This kind of arrangement provides for a frontal snap-fit coupling, according to which the handle is coupled to the front portion of the storage drawer body from the front, i.e., along a direction parallel to the storage drawer extraction/insertion direction.

SUMMARY OF THE PRESENT INVENTION

Applicant has observed that the abovementioned known solution for connecting in a releasable way a handle with a storage drawer body through a frontal snap-fit coupling is not efficient, being affected by several drawbacks.

If a small number of tooth elements was used (e.g., a single tooth element), the coupling between handle and storage drawer body may become too loose. This is a serious drawback, because the handle can accidentally detach from the storage drawer body, or worse, some of the tooth elements can broke, especially when the storage drawer body is quite heavy (e.g., when the storage drawer is a large capacity dispensing drawer loaded with a large amount of washing agents).

Therefore, in order to provide a sufficiently strong mechanical coupling between handle and storage drawer body using a frontal snap-fit coupling of the kind described above, a high number of tooth elements should be required on the internal side of the handle. However, having a high number of tooth elements located on the internal side of the handle makes the operations for detaching/attaching the handle from/to the storage drawer body very laborious and not comfortable.

In view of the above, Applicant has tackled the problem of devising a new solution for a storage drawer which is not affected by the abovementioned drawbacks.

More specifically, the Applicant provided for a storage drawer in which the handle is connected to the storage drawer body in a releasable way by means of a coupling arrangement that is stable, robust, resistant to breaks, and at the same time that allows to detach/attach the handle from/to the storage drawer body in an easy, fast and efficient way.

One or more aspects of the present invention are set out in the independent claims, with advantageous features of the same invention that are indicated in the dependent claims, whose wording is enclosed herein verbatim by reference (with any advantageous feature being provided with reference to a specific aspect of the present that applies mutatis mutandis to any other aspect thereof).

An aspect of the present invention relates to a laundry appliance.

According to an embodiment of the present invention, the laundry appliance comprises a cabinet accommodating a laundry treatment chamber and a storage drawer adapted to slide into the cabinet along a first direction.

According to an embodiment of the present invention, the storage drawer comprises a drawer body and a drawer handle.

According to an embodiment of the present invention, the drawer handle is connectable with the drawer body in a releasable way through a coupling arrangement.

According to an embodiment of the present invention, the coupling arrangement comprises:

- drawer body sliding means arranged on the drawer body, and
- drawer handle sliding means arranged on the drawer handle and adapted to slidingly engage with the drawer body sliding means for allowing the drawer handle to move with respect to the drawer body.

According to an embodiment of the present invention, said drawer body sliding means and said drawer handle sliding means extend along a second direction perpendicular to the first direction and parallel to a top surface of the cabinet so as to allow the drawer handle to be detached from the drawer body by a lateral movement along said second direction; preferably the drawer handle can be detached from the drawer body when the drawer is partially/fully extracted from the cabinet and/or when said drawer is released from said cabinet.

According to an embodiment of the present invention, the storage drawer comprises a blocking device configured to selectively block movement of the drawer handle with respect to the drawer body in a mounting position in which the drawer handle is connected with the drawer body.

According to an embodiment of the present invention, the laundry appliance further comprises an actuator element for the user manual switching of the blocking device.

According to an embodiment of the present invention, the blocking device comprises a detent element suitable to be engaged in a detent region.

According to an embodiment of the present invention, one of said detent element and detent region is provided in the drawer handle and the other being provided on the drawer body.

According to an embodiment of the present invention, the detent element is configured to be switched between:

- a locked configuration, in which the detent element engages the detent region to block the movement of the drawer handle with respect to the drawer body;
- an unlocked configuration, in which the detent element is disengaged from the detent region to allow the movement of the drawer handle with respect to the drawer body.

According to an embodiment of the present invention, the drawer handle sliding means and the detent element are located on an inner face of the drawer handle facing the drawer body when the drawer handle is connected to the drawer body.

According to an embodiment of the present invention, the detent element comprises a detent hook member and a resilient member.

According to an embodiment of the present invention, the resilient member exerts a resilient force pushing the detent hook member against the detent region when the drawer handle is connected to the drawer body.

According to an embodiment of the present invention, the resilient member is configured to exert a resilient force pushing the detent hook member against the detent region along the first direction when the drawer handle is connected to the drawer body.

According to an embodiment of the present invention, the detent element comprises an actuator portion adapted to be operated by the user to manually switch said detent element from the locked to the unlocked configuration.

According to an embodiment of the present invention, the actuator portion is comprised in the detent hook member.

According to an embodiment of the present invention, said actuator portion is adapted to be pushed to enable the detent element to disengage the detent region by pushing the detent hook member away from the detent region against the resilient force exerted by the resilient member.

According to an embodiment of the present invention, the drawer body comprises a support wall suitable to support the handle on the mounting position, the drawer body sliding means and the detent region being located on said support wall.

According to an embodiment of the present invention, the drawer body comprises a recessed portion defining a free space behind (along the first direction) the support wall to allow a user to reach the detent region and push the actuator portion when the drawer handle is connected to the drawer body.

According to an embodiment of the present invention, the blocking device, preferably the detent element, is located between two drawer handle sliding means.

According to an embodiment of the present invention, the drawer body sliding means comprise upper drawer body sliding means located at an upper portion of the drawer body and lower drawer body sliding means located at a lower portion of the drawer body.

According to an embodiment of the present invention, the drawer handle sliding means comprise upper drawer handle sliding means located at an upper portion of the drawer handle and lower drawer handle sliding means located at a lower portion of the handle.

According to an embodiment of the present invention, the drawer handle sliding means extend across substantially the entire width of the handle along the second direction.

According to an embodiment of the present invention, the laundry appliance further comprises a decorative outer shell connected to an outer side of the drawer handle.

According to an embodiment of the present invention, the outer shell is configured to be flush with a front surface of the cabinet when the storage drawer is completely inserted into the cabinet.

Another aspect of the present invention relates to a dispensing drawer for a laundry appliance.

According to an embodiment of the present invention, the dispensing drawer is adapted to slide into the laundry appliance along a first direction.

According to an embodiment of the present invention, the dispensing drawer comprises a drawer body and a drawer handle.

According to an embodiment of the present invention, the drawer body comprises a top portion provided with at least one opening to access from above at least one drawer compartment.

According to an embodiment of the present invention, the drawer body comprises a bottom portion opposite to the top portion and linked to the top portion through lateral portions.

According to an embodiment of the present invention, the drawer body comprises a front portion perpendicular to the top portion and to said first direction.

According to an embodiment of the present invention, the front portion is adapted to receive the drawer handle.

According to an embodiment of the present invention, the drawer handle is connectable to the front portion of the drawer body in a releasable way through a coupling arrangement.

According to an embodiment of the present invention, the coupling arrangement comprises drawer body sliding means arranged on the drawer body.

According to an embodiment of the present invention, the coupling arrangement comprises drawer handle sliding means arranged on the drawer handle and adapted to slidingly engage with the drawer body sliding means for allowing the drawer handle to move with respect to the drawer body.

According to an embodiment of the present invention, the drawer body sliding means and the drawer handle sliding means extend along a second direction perpendicular to the first direction and parallel to the top portion so as to allow the drawer handle to be detached from the front portion of the drawer body by a lateral movement along said second direction.

According to an embodiment of the present invention, the dispensing drawer further comprises a blocking device configured to selectively block movement of the drawer handle with respect to the drawer body in a mounting position in which the drawer handle is connected with the drawer body.

According to an embodiment of the present invention, the blocking device comprises a detent element suitable to be engaged in a detent region.

According to an embodiment of the present invention, one of said detent element and detent region is provided in the drawer handle and the other is provided on the drawer body.

According to an embodiment of the present invention, the detent element is configured to be switched between:

- a locked configuration, in which the detent element engages the detent region to block the movement of the drawer handle with respect to the drawer body;
- an unlocked configuration, in which the detent element is disengaged from the detent region to allow the movement of the drawer handle with respect to the drawer body.

According to an embodiment of the present invention, the drawer handle sliding means and the detent element are located on an inner face of the drawer handle facing the drawer body when the drawer handle is connected to the front portion of the drawer body.

According to an embodiment of the present invention, the detent element comprises a detent hook member and a resilient member.

According to an embodiment of the present invention, the resilient member exerts a resilient force pushing the detent hook member against the detent region when the drawer handle is connected to the front portion of the drawer body.

According to an embodiment of the present invention, the resilient member is configured to exert a resilient force pushing the detent hook member against the detent region along a first direction when the drawer handle is connected to the drawer body.

According to an embodiment of the present invention, the dispensing drawer further comprises an actuator element for the user manual switching of the blocking device.

According to an embodiment of the present invention, the detent hook member further comprises an actuator portion adapted to be pushed to enable the detent element to disengage the detent region by pushing the detent hook member away from the detent region against the resilient force exerted by the resilient member.

According to an embodiment of the present invention, the front portion of the drawer body comprises:

- a support wall, the drawer body sliding means and the detent region being located on said support wall;
- a recessed portion defining a free space behind the support wall to allow a user to reach the detent region and push the actuator portion when the drawer handle is connected to the front portion of the drawer body.

According to an embodiment of the present invention, the blocking device, preferably he detent element, is located between two drawer handle sliding means.

According to an embodiment of the present invention, the drawer body sliding means comprise upper drawer body sliding means located at an upper portion of the front portion of the drawer body and lower drawer body sliding means located at a lower portion of the front portion of the drawer body.

According to an embodiment of the present invention, the drawer handle sliding means comprises upper drawer handle sliding means located at an upper portion of the drawer handle and lower drawer handle sliding means located at a lower portion of the handle.

According to an embodiment of the present invention, the drawer handle sliding means extend across substantially the entire width of the handle along the second direction.

According to an embodiment of the present invention, the dispensing drawer further comprises a decorative outer shell connected to an outer side of the drawer handle.

DETAILED DESCRIPTION OF EXEMPLARY AND NON-LIMITATIVE EMBODIMENTS OF THE PRESENT INVENTION

Figure 1A:
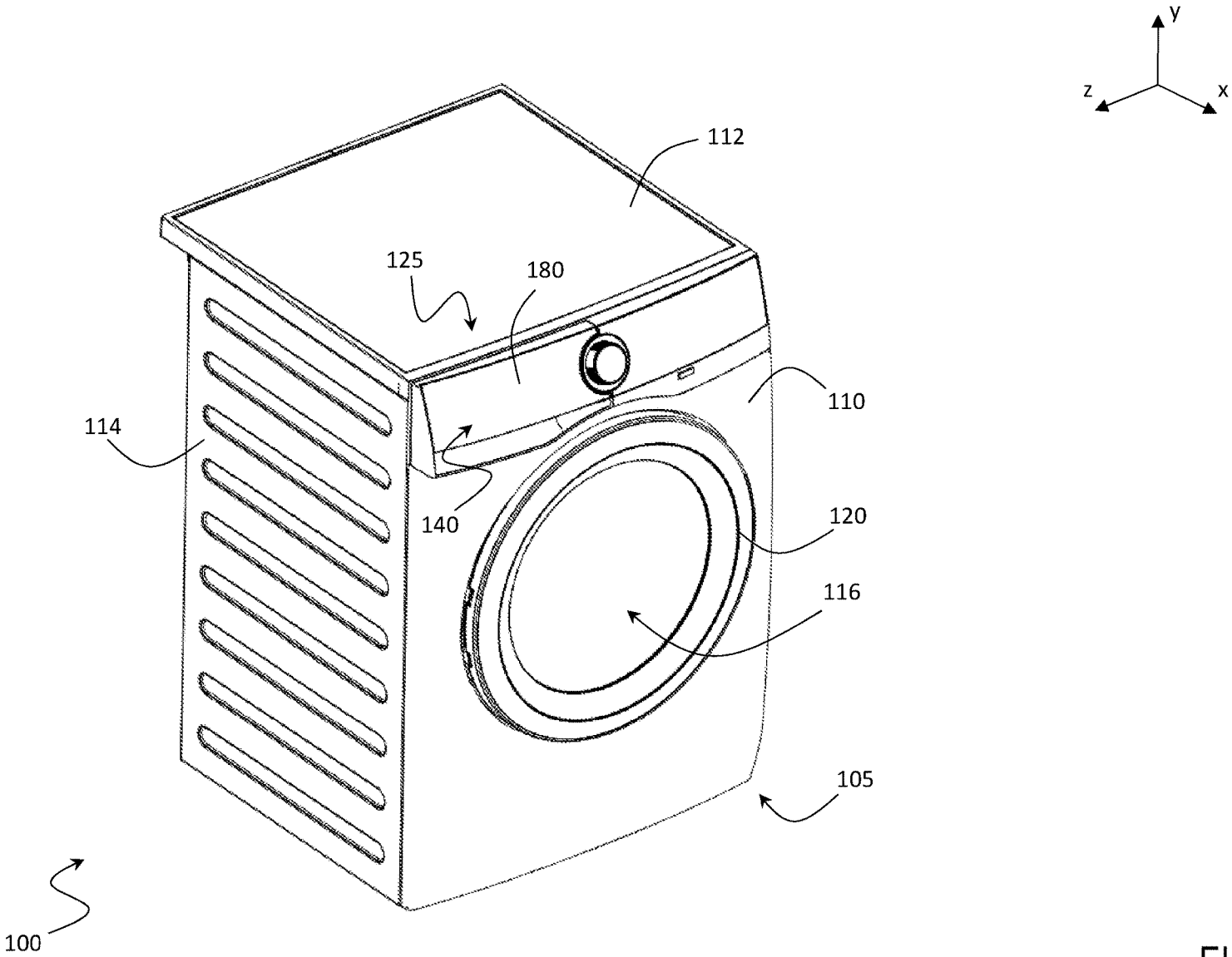
FIGS. 1A and 1B are perspective views of a laundry appliance in which a drawer according to embodiments of the present invention can be used.
Figure 1B:
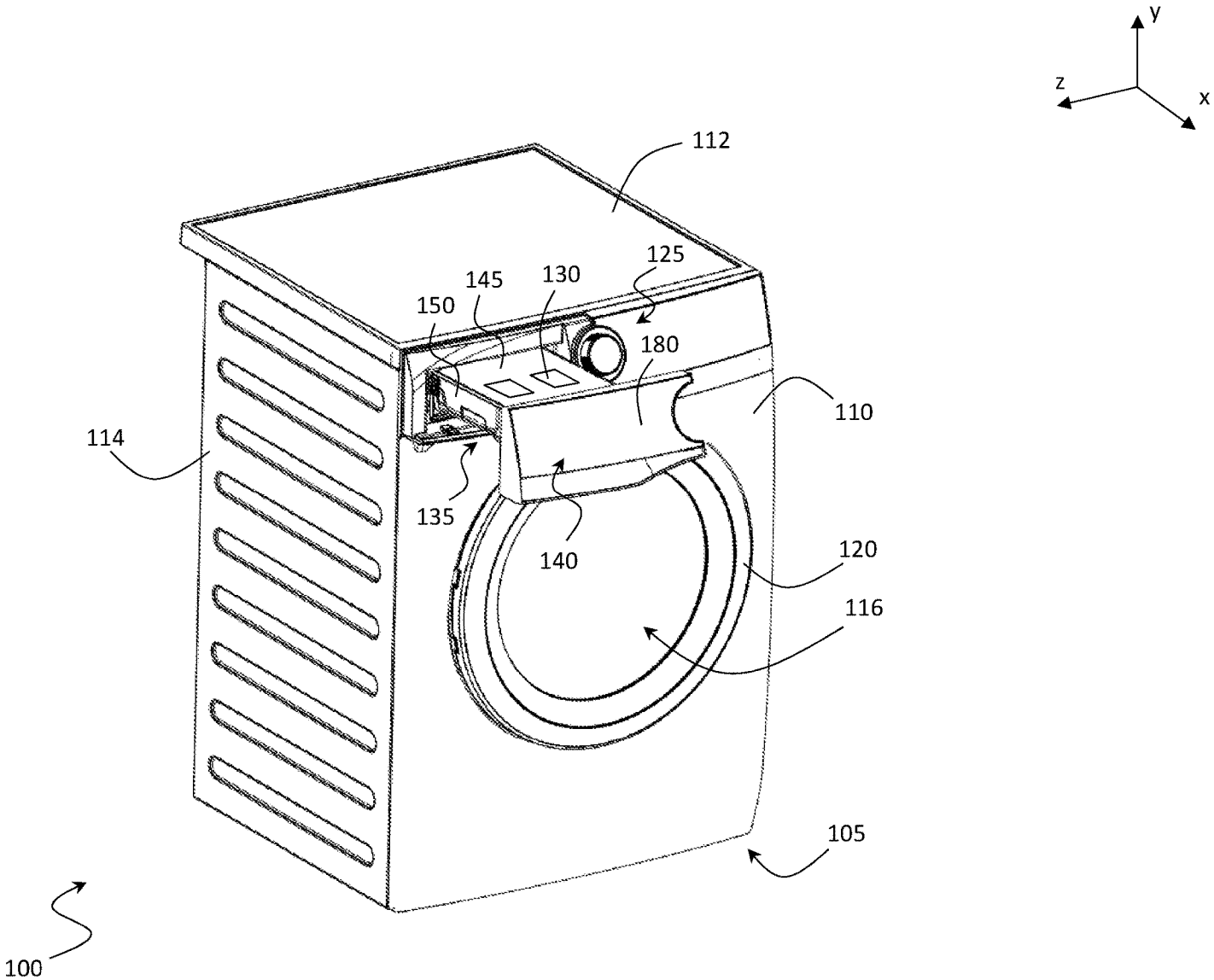

With reference to the drawings, sharing the same reference system identified by the three orthogonal directions x, y and z, in FIGS. 1A and 1B there is shown in a perspective view a laundry appliance 100, for example, although not limitatively, a laundry washing machine, particularly a front-loading laundry washing machine, equipped with a storage drawer according to embodiments of the present invention.

It is pointed out that although here and in the following description reference is made to a laundry washing machine and to a storage drawer which is a dispensing drawer for dispensing washing agents into a laundry treatment chamber of the laundry washing machine, this is not to be construed as a limitation, because the present invention also covers and applies to combined laundry washing and drying machines. Moreover, the concepts of the present invention may be also applied to a laundry-drying machine of the condensation type, in which the storage drawer is configured to collect condensed moisture generated by the condensing of process air.

The laundry appliance 100 comprises a cabinet 105, for example parallepiped-shaped, having a front side 110 extending parallel to directions y and z, a rear side (not visible in the figures but extending parallel to the front side 110), a top side 112 extending parallel to directions x and z, a bottom side (not visible in the figures but extending parallel to the top side 112), and two lateral sides 114 extending parallel to directions x and y (only one visible in the figures). The cabinet 105 accommodates therein a laundry treatment chamber (laundry washing chamber in the example here considered) for one or more items to be treated, i.e., to be washed. The treatment chamber comprises a washing tub housing a preferably rotatable drum (not visible in the figures) which is adapted to contain the items to be washed.

In order to allow a user to access the washing tub and the inside of the drum (for loading/unloading the items to be washed), a loading/unloading opening 116, closable by a door 120, is advantageously provided on the front side 110 of the laundry appliance 100.

A dispensing system is arranged in of the laundry appliance 100, preferably in the upper part, for supplying washing liquids (water or washing agents mixed with water) inside the laundry treatment chamber. The dispensing system comprises a dispensing drawer 125 adapted to receive and contain loads of washing agents. The dispensing drawer 125 is adapted to slide into (a drawer support structure located in) the laundry appliance along an extraction/insertion direction parallel to direction x between:

- an extracted position (illustrated in FIG. 1B), in which the dispensing drawer 125 is at least partially extracted from the cabinet 105, protruding from the front side 110, to expose loading openings 130 (parallel to the directions x and z) adapted to allow an user to load washing agents into washing agents compartments of the dispensing drawer 125, and
- an inserted position (illustrated in FIG. 1A), in which the dispensing drawer 125 is retracted inside the cabinet 105, the loading openings 130 are no longer exposed, and the washing agents contained in the washing agents compartments can be delivered into the laundry treatment chamber according to a selected laundry treatment cycle during the operation of the laundry appliance 100.

Additionally, the dispenser drawer 125 may be also advantageously completely disengaged from the cabinet 105, for allow an user to wash the dispensing drawer 125.

The dispensing drawer 125 preferably comprises a drawer body 135 and a drawer handle 140.

The drawer body 135 preferably houses the washing agents compartments (not visible in the figures) adapted to store washing agent, and channeling structures for allowing water and/or water mixed with the washing agents contained in the washing agents compartments to be selectively delivered into the laundry treatment chamber according to the laundry treatment cycle carried out by the laundry appliance 100. The drawer body 135 comprises a top portion 145 extending parallel to directions x and z wherein the loading openings 130 for accessing the washing agents compartments are located, a bottom portion (not visible in the figures) opposite to the top portion 145 and linked to the top portion 145 through lateral portions 150 extending parallel to directions x and y, and a front portion (not visible in FIGS. 1A and 1B) extending along directions y and z adapted to receive the drawer handle 140.

The drawer handle 140 is configured to provide a user with an handhold that allows her/him to easily pull/push the dispensing drawer 125 between the extracted position and the inserted position.

A decorative outer shell 180 may be advantageously provided, which covers an outer face of the drawer handle 140 and is preferably designed to be flush with the outer surface of the front side 110 of the cabinet 105 when the dispensing drawer 125 is in the inserted position.

Advantageously, the drawer handle 140 is connectable to the drawer body 135 in a releasable way.

According to an embodiment of the present invention, the drawer handle 140 is connectable to the front portion of the drawer body 135 in a releasable way through a coupling arrangement that allows the drawer handle 140 to be advantageously detached from the front portion of the drawer body 135 by a lateral movement along the direction z, i.e., along a direction which is perpendicular to the extraction/insertion direction and at the same time parallel to the top portion 145 of the drawer body 135 (and parallel to the surface of the top side 112 of the casing 105).

In order to illustrate in detail how the coupling arrangement according to an embodiment of the present invention allows the drawer handle 140 to be detached from the front portion of the drawer body 135, reference will be now made to FIGS. 2A-2C and FIGS. 3A-3C.

Figure 2A:
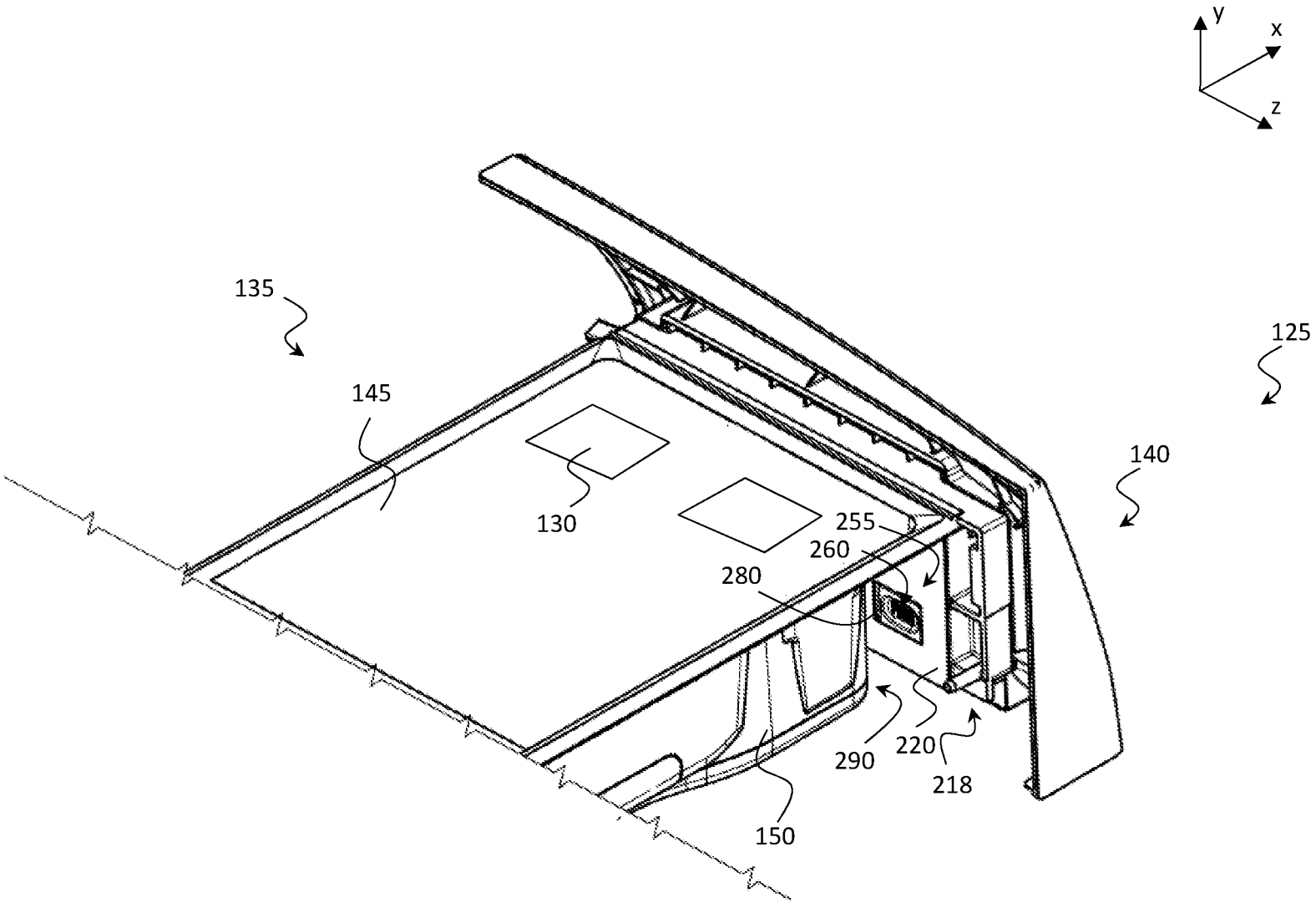
FIGS. 2A-2C are perspective views from behind of the relative positioning between a drawer handle and a drawer body of a dispensing drawer of the laundry appliance of FIGS. 1A and 1B according to an embodiment of the present invention.
Figure 2B:
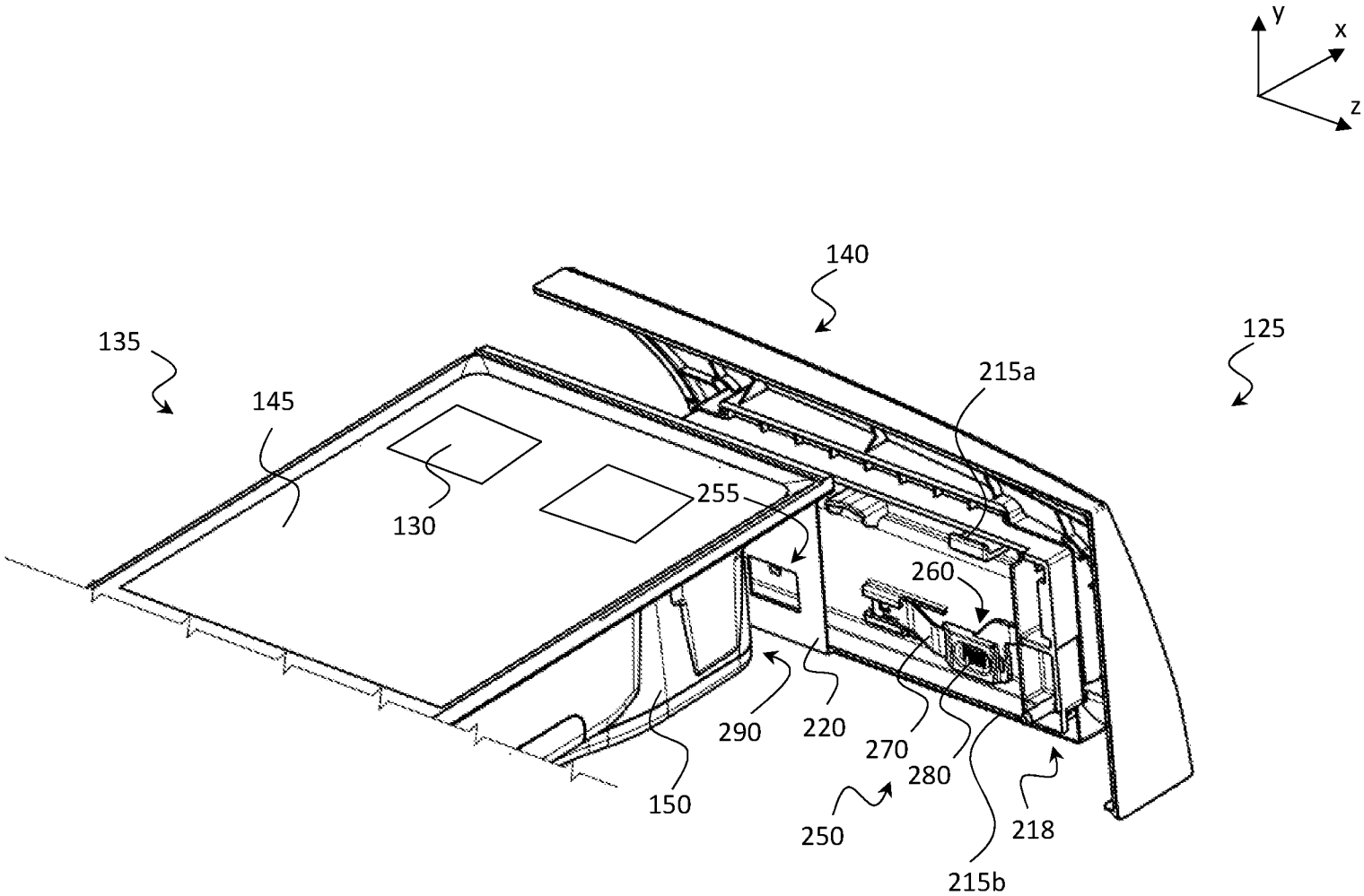
Figure 2C:
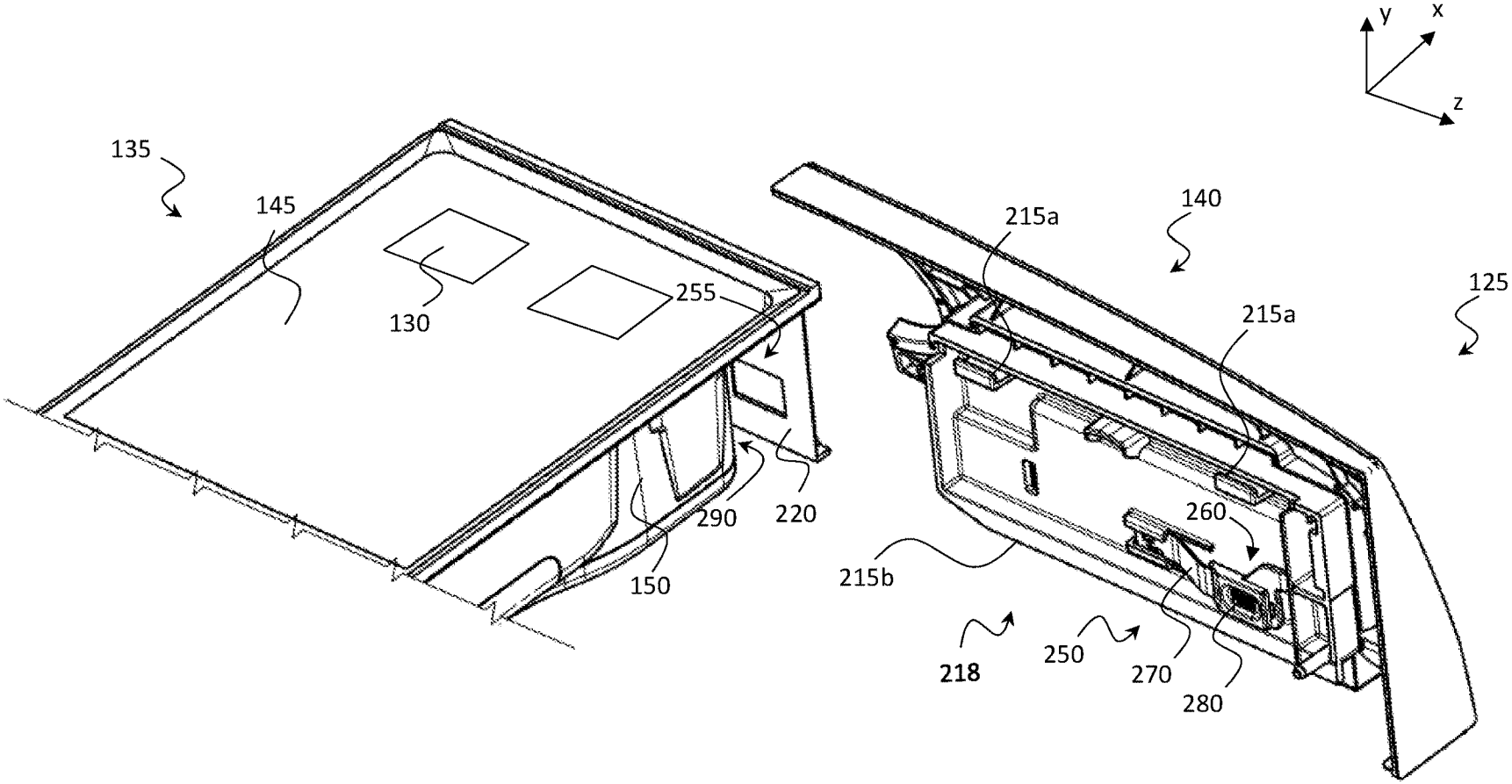
Figure 3A:
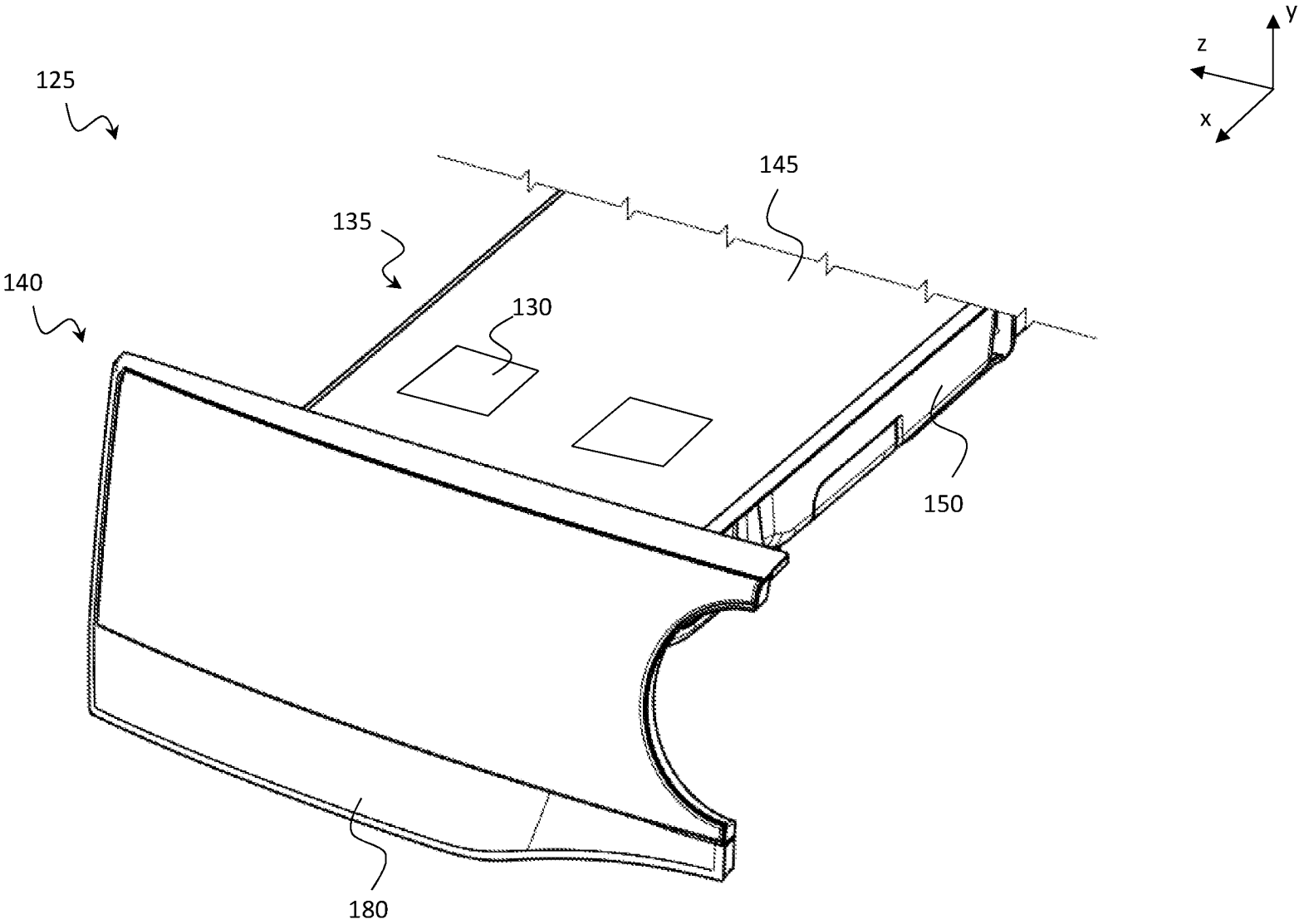
FIGS. 3A-3C are perspective views from the front of the relative positioning between the drawer handle and the drawer body of the dispensing drawer illustrated in FIGS. 2A-2C.
Figure 3B:
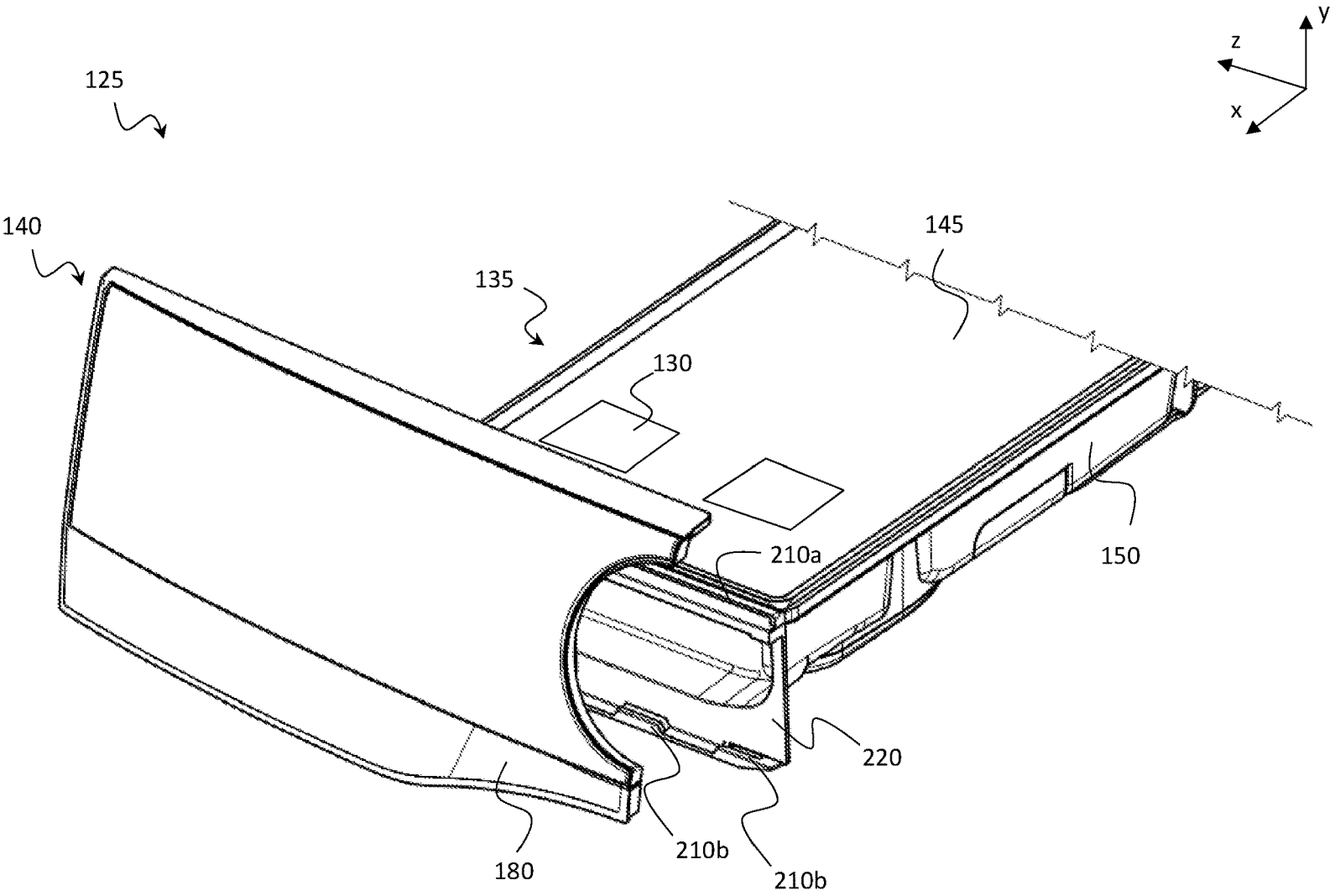
Figure 3C:
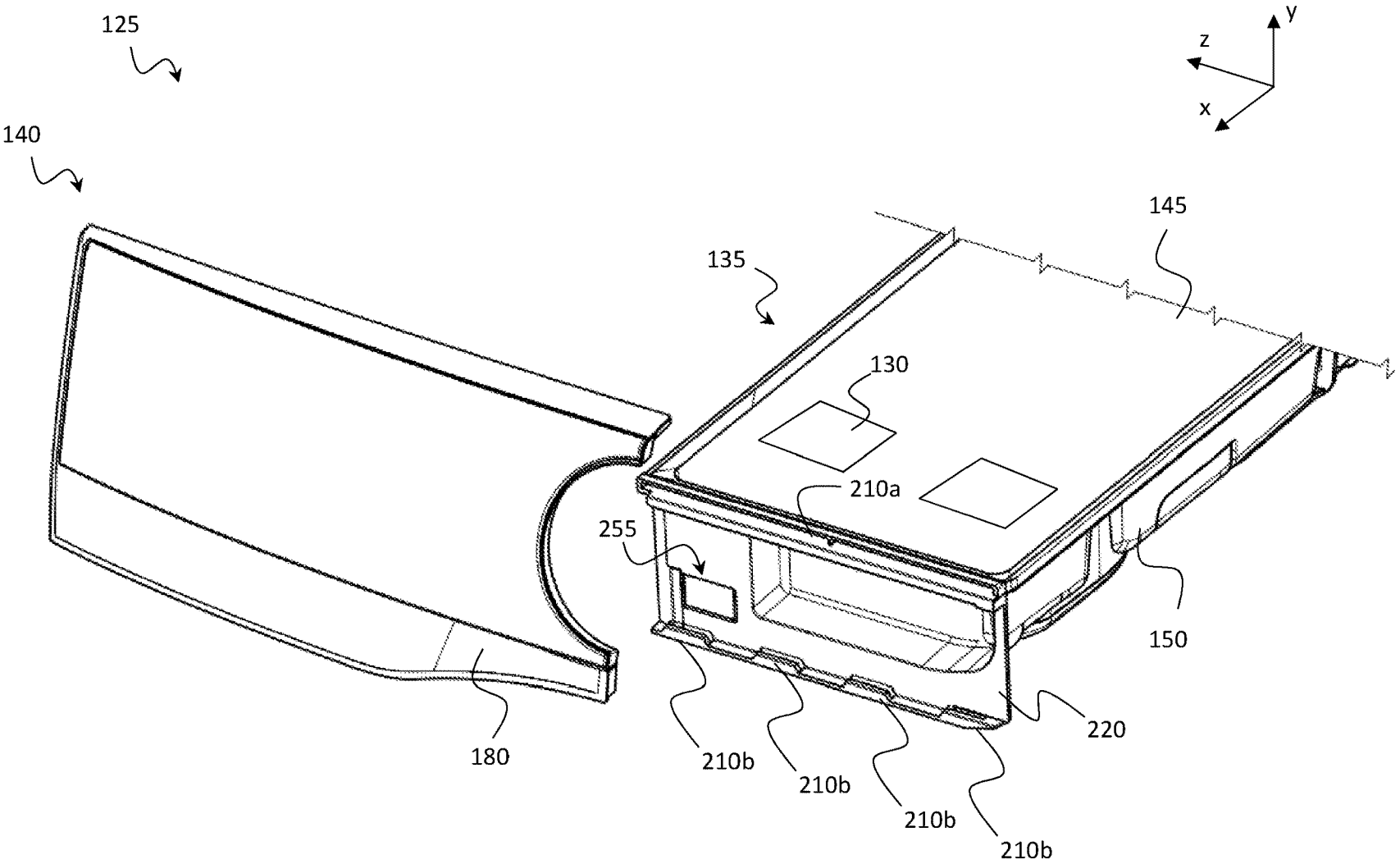

FIGS. 2A-2C are perspective views from behind of the relative positioning between the drawer handle 140 and the drawer body 135 at different stages of the lateral movement along the direction z allowed by the coupling arrangement according to an embodiment of the present invention. FIGS. 3A-3C are perspective views from the front of the same stages of relative positioning between the drawer handle 140 and the drawer body 135 illustrated in FIGS. 2A-2C.

FIGS. 2A and 3A illustrate the situation in which the drawer handle 140 is actually fastened to the drawer body 135; in this way, a user is allowed to avail herself/himself of the drawer handle 140 for pulling/pushing the dispensing drawer 125 from/into the cabinet 105 between the extracted position and the inserted position. In FIGS. 2B and 3B, the drawer handle 140 is partially disengaged from the drawer body 135, being partially slid apart from the latter along direction z, while in FIGS. 2C and 3C, the drawer handle 140 is entirely detached from the drawer body 135.

According to an embodiment of the present invention, the coupling arrangement comprises drawer body sliding means arranged on the drawer body 135 and drawer handle sliding means arranged on the drawer handle 140.

According to an embodiment of the present invention, the drawer handle sliding means comprises drawer handle rail elements 215*a*, 215*b* and the drawer body sliding means comprises drawer body rail elements 210*a*, 210*b*. The drawer handle rail elements 215*a*, 215*b* are preferably adapted to slidingly engage with the drawer body rail elements 210*a*, 210*b* for allowing the drawer handle 140 to move with respect to the drawer body 135.

According to an embodiment of the present invention, the drawer body rail elements 210*a*, 210*b* and the drawer handle rail elements 215*a*, 215*b* extend along direction z, i.e., extend along a direction which is perpendicular to the extraction/insertion direction and at the same time parallel to the top portion 145 of the drawer body 135 (and parallel to the surface of the top side 112 of the casing 105).

The drawer handle rail elements 215*a*, 215*b* are preferably located on an inner face 218 of the drawer handle 140, i.e., a face of the drawer handle 140 facing the drawer body 135 when the drawer handle 140 is connected to the drawer body 135.

According to an embodiment of the present invention, the drawer handle rail elements 215*a*, 215*b* comprise an upper drawer handle rail element 215*a* located at an upper portion of the inner face 218 of the drawer handle 140 and a lower drawer handle rail element 215*b* located at a lower portion of the inner face 218 of the drawer handle 140.

According to an embodiment of the present invention, the drawer handle rail elements 215*a*, 215*b* extend across substantially the entire width of the handle 140 along the direction z.

In the embodiment of the invention illustrated in the figures, while the lower drawer handle rail element 215*b* is a continuous rail element, extending (along direction z) across the width of the handle 140 without interruptions, the upper drawer handle rail element 215*a* is discontinuous, and comprises two separated rail sub-elements which are spaced apart to each other. In any case, the concepts of the present inventions apply also in case the upper drawer handle rail element 215*a* comprises a different number of rail sub-elements, or in case the upper drawer handle rail element 215*a* is a continuous rail element, and/or in case the lower drawer handle rail element 215*b* is a discontinuous rail element (comprising two or more separated rail sub-elements).

According to an embodiment of the present invention, the front portion of the drawer body 135 comprises a support wall 220 preferably extending along directions y and z; the drawer body rail elements 210*a*, 210*b* are preferably located on an outer face of the support wall 220, i.e., a face thereof which is facing the drawer handle 140 when the drawer handle 140 is connected to the drawer body 135.

According to an embodiment of the present invention, the drawer body rail elements 210*a*, 210*b* comprise an upper drawer body rail element 210*a* located at an upper portion of the outer face of the support wall 220 and a lower drawer body rail element 210*b* located at a lower portion of the outer face of the support wall 220.

According to an embodiment of the present invention, the drawer body rail elements 210*a*, 210*b* extend across substantially the entire width of the support wall 220 along the direction z.

In the embodiment of the invention illustrated in the figures, while the upper drawer body rail element 210*a* is a continuous rail element, extending (along direction z) across the width of the support wall 220 without interruptions, the lower drawer body rail element 210*b* is discontinuous, and comprises four separated rail sub-elements which are spaced apart to each other. In any case, the concepts of the present inventions apply also in case the lower drawer body rail element 210*b* comprises a different number of rail sub-elements, or in case the lower drawer body rail element 210*b* is a continuous rail element, and/or in case the upper drawer body rail element 210*a* is a discontinuous rail element (comprising two or more separated rail sub-elements).

According to an embodiment of the present invention, the drawer handle rail element 215*a* is configured to slidingly engage the drawer body rail element 210*a*, and the drawer handle rail element 215*b* is configured to slidingly engage the drawer body rail element 210*b*, providing thus a stable and robust coupling between the drawer handle 140 and the drawer body 135.

According to an embodiment of the present invention, a blocking device 250 is provided, configured to selectively block the movement of the drawer handle 140 with respect to the drawer body 135 along direction z. The blocking device 250 is designed in such a way to inhibit the movement of the drawer handle 140 with respect to the drawer body 135 in a mounting position in which the drawer handle 140 is steadily fastened to the drawer body 135, and at the same is capable of easily allowing the movement of the drawer handle 140 with respect to the drawer body 135 (and therefore allowing the detachment of the former with respect to the latter) when required, e.g., for carrying out cleaning operations on the dispensing drawer 125.

According to an embodiment of the present invention, the blocking device 250 is a detent element located on the inner face 218 of the drawer handle 140 and configured to be switched between:

- a locked configuration, in which the detent element 250 engages a corresponding detent region 255 on the drawer body, e.g., on the support wall 220, blocking the movement of the drawer handle 140 with respect to the drawer body 135 along direction z, and
- an unlocked configuration, in which the detent element 250 is disengaged from the detent region 255, to allow the movement of the drawer handle 140 with respect to the drawer body 135 along direction z.

According to an embodiment of the present invention, the detent region 255 comprises a window opened in the support wall 220, for example a rectangular window.

According to an alternative embodiment of the present invention, the detent element 250 is located on the drawer body, e.g., on the support wall 220, while the detent region 255 is located on the drawer handle 140, e.g., on the inner face 218 thereof.

Figure 4:
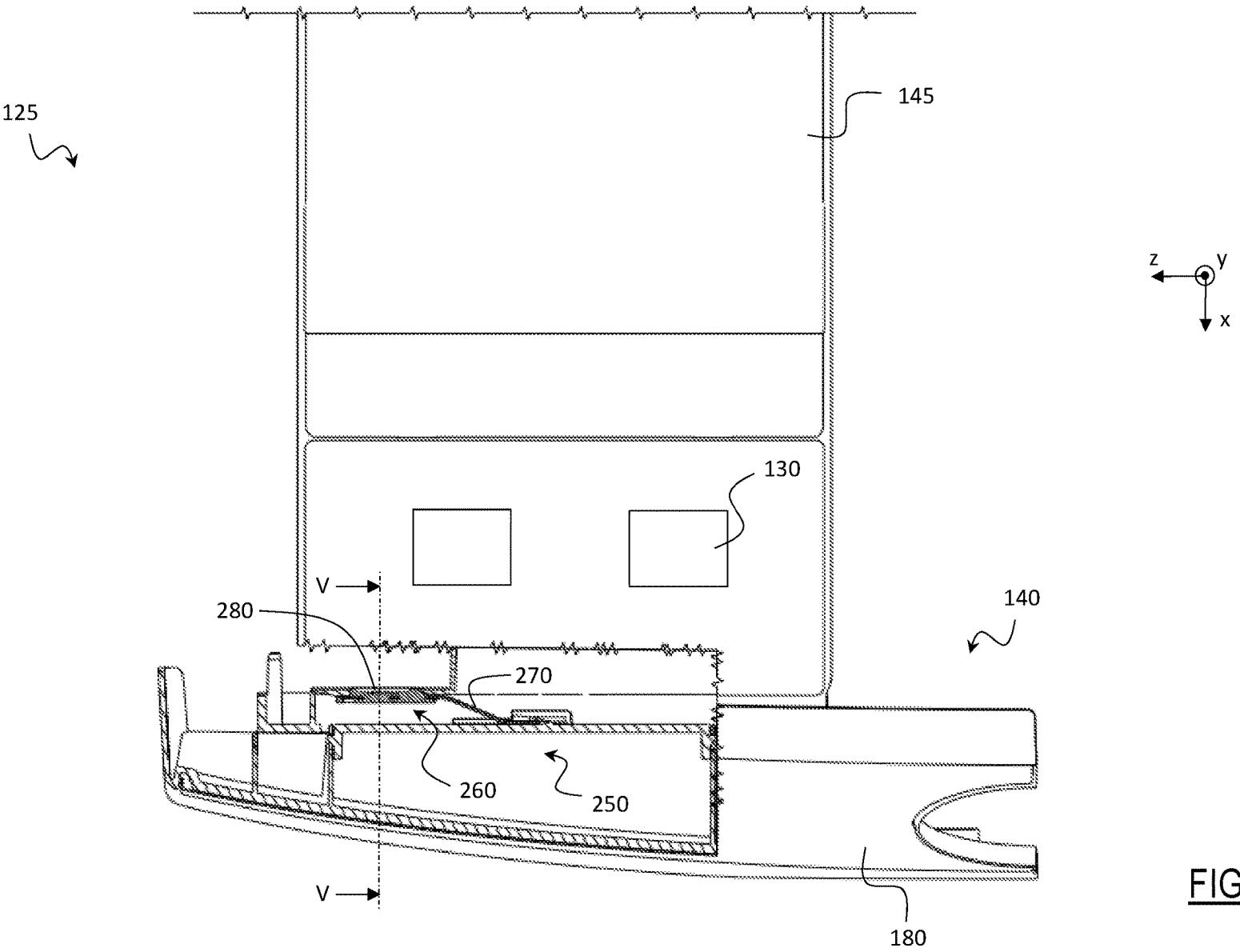
FIG. 4 is a view from above of the dispensing drawer illustrated in FIGS. 2A and 3A with a portion thereof that is partially sectioned.
Figure 5:
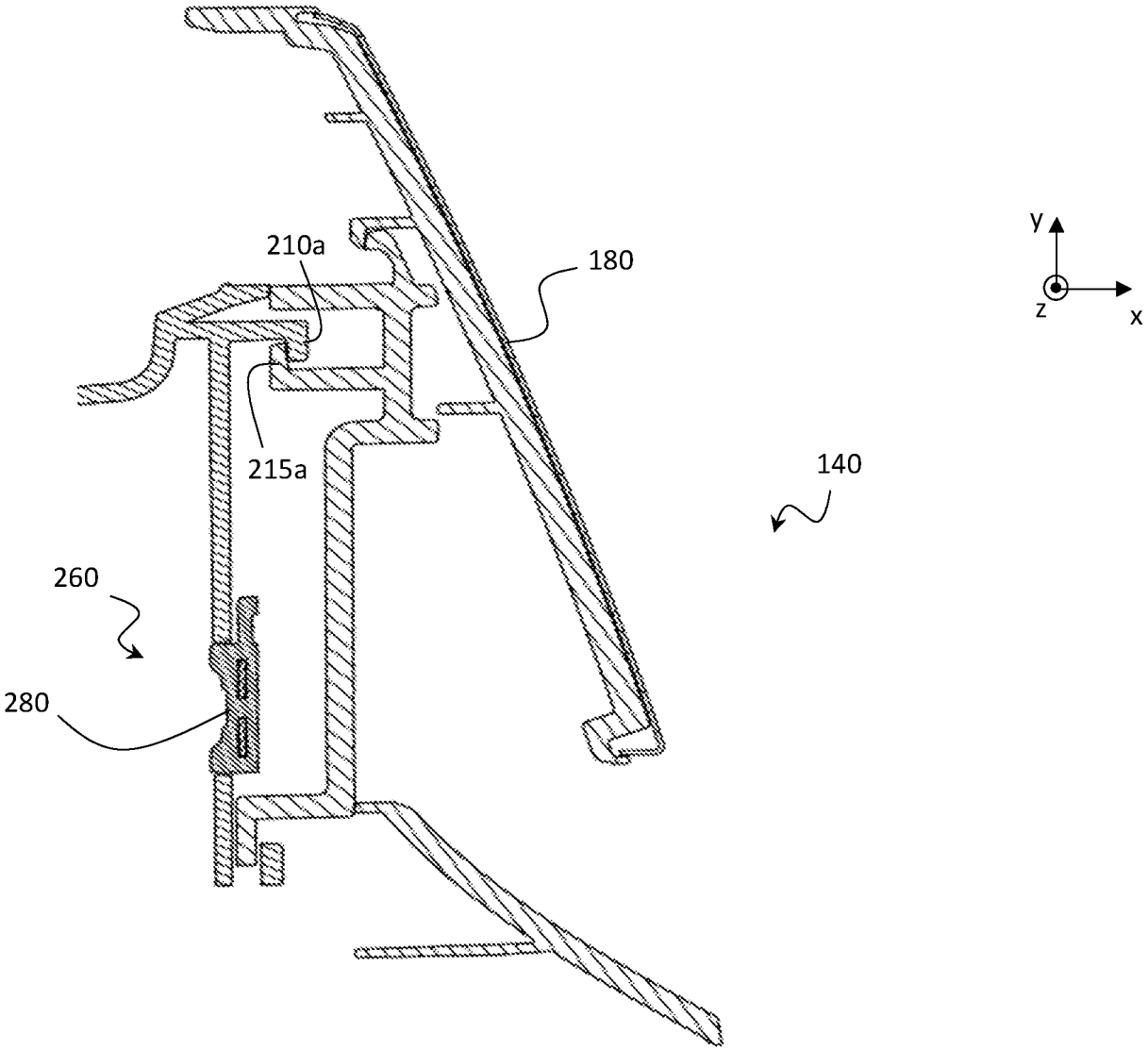
FIG. 5 is a section view of the dispensing drawer of FIG. 4 along the line V-V.

In order to better illustrate the detent element 250 according to an embodiment of the present invention, reference will be now made also to FIGS. 4 and 5, wherein FIG. 4 is a view from above of the dispensing drawer 125 in the extracted position, with the drawer handle 140 fastened to the drawer body 135 and with a portion thereof that is partially sectioned along a section plane parallel to directions x and z, and FIG. 5 is a section view of the dispensing drawer 125 of FIG. 4 taken from a section plane parallel to directions x and y and containing the line V-V.

According to an embodiment of the present invention, the detent element 250 comprises a detent hook member 260 comprising at least one hook and supported by a resilient member 270. The resilient member 270, for example a strip element, has, along direction z, a first end connected to the inner face 218 of the drawer handle 140 and a second end connected to the detent hook member 260. The resilient member 270 protrudes from the inner face 218 of the drawer handle 140.

According to an embodiment of the present invention, the resilient member 270 is designed to exert a resilient force, preferably pushing the detent hook member 260 against the support wall 220 of the drawer body 135. More particularly, the resilient member 270 is designed in such a way that, when the detent element 250 is in the locked configuration, the detent hook member 260 is pushed against the detent region 255.

According to an embodiment of the present invention, the shape of the detent region 255 and the shape of the detent hook member 260 are such that, when in the locked configuration, the detent hook member 260 fits in the detent region 255, with the hook(s) of the detent hook member 260 that pass through the window of the detent region 255 and are in abutment with side borders of the latter, inhibiting the movement of the drawer handle 140 with respect to the drawer body 135 along direction z.

According to an embodiment of the present invention, the detent element 250 is arranged on the inner face 218 of the drawer handle 140 in such a way to be located between the upper drawer handle rail element 215*a* and the lower drawer handle rail element 215*b*.

According to an embodiment of the present invention, an actuator element is provided for the user manual switching of the blocking device.

According to an embodiment of the present invention, the actuator element comprises an actuator portion 280 included in the detent hook member 260 and designed to be pushed for disengaging the detent element 250 from the detent region 255. By pushing the actuator portion 280, the detent hook member 260 is pushed away from the detent region 255 against the resilient force exerted by the resilient member 270.

The concepts of the present invention can be also applied in case the actuator element has a different structure and/or is located in a different position, such as for example not directly included in the detent hook member 260.

According to an embodiment of the present invention, the drawer body 135 comprises at its front portion a recessed portion defining a free space 290 behind the support wall 220 to allow a user to reach the detention region 255 and push the actuator portion 280 (when the detent element 250 is in the locked configuration) for disengaging the detent element 250 from the detent region 255.

When the detent element 250 is in the locked configuration (situation depicted in FIGS. 2A and 3A), the drawer handle 140 is strongly fastened to the drawer body 135, and the former cannot slide with respect to the latter because the only movement allowed by the rail elements of the coupling arrangement (i.e., along direction z) is blocked by the detent element 250, since the detent hook member 260 fits in the detent region 255, with the hook(s) of the detent hook member 260 that pass through the window of the detent region 255 and are in abutment with side borders of the latter.

In order to switch the detent element 250 from the locked configuration to the unlocked configuration, the user pushes the actuator portion 280, preferably reaching the detention region 255 through the free space 290 behind the support wall 220, causing the detent element 250 to disengage from the detent region 255. In this way, the drawer handle 140 can be slid with respect to the drawer body 135 along direction z by means of the rail elements of the coupling arrangement (see FIGS. 2B and 3B) until the drawer handle rail elements 215*a*, 215*b* disengage the drawer body rail elements 210*a*, 210*b*, entirely detaching the drawer handle 140 from the drawer body 135 (see FIGS. 2C and 3C).

In order to attach again the drawer handle 140 to the drawer body 135, it is sufficient to position the drawer handle 140 to the side of the drawer body 135 in such a way to align the drawer handle rail elements 215*a*, 215*b* to the drawer body rail elements 210*a*, 210*b*, and move the drawer handle 140 along direction z in order to have the drawer handle rail elements 215*a*, 215*b* that slidingly engage again the drawer body rail elements 210*a*, 210*b*. The sliding movement along direction z of the drawer handle 140 with respect to the drawer body 135 is then automatically stopped when the detent hook member 260 (which during the sliding movement is pushed against the support wall 220 by the resilient member 270) aligns itself with the detent region 255. Indeed, in this condition, the resilient force exerted by the resilient member 270 causes the detent hook member 260 to engage the detent region 255, thus causing the detent element 250 to switch back into the locked configuration.

The solutions according to the embodiments of the invention described herein provide for a releasable connection between drawer handle and drawer body that is stable, robust, resistant to breaks, and at the same time allows to detach/attach the drawer handle from/to the drawer body in an easy, fast and efficient way.

The present invention has been here described in detail making reference to some possible embodiments thereof. Other embodiments are possible and at the reach of the person skilled in the art.

The invention claimed is:

1. A laundry appliance, comprising:

a cabinet accommodating a laundry treatment chamber; and a storage drawer adapted to slide into the cabinet along a first direction, the storage drawer comprising a drawer body and a drawer handle, the drawer handle being connectable with the drawer body in a releasable way through a coupling arrangement, wherein the coupling arrangement comprises:

drawer body sliding means arranged on the drawer body, and drawer handle sliding means arranged on the drawer handle and adapted to slidingly engage with the drawer body sliding means for allowing the drawer handle to move with respect to the drawer body, wherein:

said drawer body sliding means and said drawer handle sliding means extend along a second direction perpendicular to the first direction and parallel to a top surface of the cabinet so as to allow the drawer handle to be detached from the drawer body by a lateral movement along said second direction.

2. The laundry appliance of claim 1, wherein the storage drawer comprises a blocking device configured to selectively block movement of the drawer handle with respect to the drawer body in a mounting position in which the drawer handle is connected with the drawer body.

3. The laundry appliance of claim 2, further comprising an actuator element configured to allow manual switching of the blocking device.

4. The laundry appliance of claim 2, wherein the blocking device comprises a detent element configured to be engaged in a detent region, one of said detent element and detent region being provided in the drawer handle and the other being provided on the drawer body, the detent element being configured to be switched between:

a locked configuration, in which the detent element engages the detent region to block the movement of the drawer handle with respect to the drawer body; and an unlocked configuration, in which the detent element is disengaged from the detent region to allow the movement of the drawer handle with respect to the drawer body.

5. The laundry appliance of claim 4, wherein the detent element comprises a detent hook member and a resilient member, the resilient member exerting a resilient force pushing the detent hook member against the detent region when the drawer handle is connected to the drawer body.

6. The laundry appliance of claim 4, wherein the detent element comprises an actuator portion configured to be operated by the user to manually switch said detent element from the locked to the unlocked configuration.

7. The laundry appliance of claim 6, wherein the actuator portion is comprised in the detent hook member, said actuator portion being adapted to be pushed to enable the detent element to disengage the detent region by pushing the detent hook member away from the detent region against the resilient force exerted by the resilient member.

8. The laundry appliance of claim 6, wherein the drawer body comprises:

a support wall configured to support the drawer handle on the mounting position, the drawer body sliding means and the detent region being located on said support wall; and a recessed portion defining a free space behind the support wall to allow a user to reach the detent region and push the actuator portion when the drawer handle is connected to the drawer body.

9. The laundry appliance of claim 2, wherein the blocking device is located between two drawer handle sliding means.

10. The laundry appliance of claim 1, wherein:

the drawer body sliding means comprise an upper drawer body sliding means located at an upper portion of the drawer body and a lower drawer body sliding means located at a lower portion of the drawer body; and the drawer handle sliding means comprise an upper drawer handle sliding means located at an upper portion of the drawer handle and a lower drawer handle sliding means located at a lower portion of the handle.

11. The laundry appliance of claim 1, further comprising a decorative outer shell connected to an outer side of the drawer handle.

12. A dispensing drawer for a laundry appliance, the dispensing drawer being configured to slide into the laundry appliance along a first direction (x), the dispensing drawer comprising:

a drawer body and a drawer handle, the drawer body comprising a top portion provided with at least one opening to access from above at least one drawer compartment, a bottom portion opposite to the top portion and linked to the top portion through lateral portions, and a front portion perpendicular to the top portion and to said first direction, the front portion being adapted to receive the drawer handle, wherein:

the drawer handle is connectable to the front portion of the drawer body in a releasable way through a coupling arrangement, the coupling arrangement comprising drawer body sliding means arranged on the drawer body, and drawer handle sliding means arranged on the drawer handle and adapted to slidingly engage with the drawer body sliding means for allowing the drawer handle to move with respect to the drawer body, and wherein:

the drawer body sliding means and the drawer handle sliding means extend along a second direction perpendicular to the first direction and parallel to the top portion so as to allow the drawer handle to be detached from the front portion of the drawer body by a lateral movement along said second direction.

13. The dispensing drawer of claim 12, further comprising a blocking device configured to selectively block movement of the drawer handle with respect to the drawer body in a mounting position in which the drawer handle is connected with the drawer body.

14. The dispensing drawer of claim 13, wherein the blocking device comprises a detent element suitable to be engaged in a detent region, one of said detent element and detent region being provided in the drawer handle and the other being provided on the drawer body, the detent element being configured to be switched between:

a locked configuration, in which the detent element engages the detent region to block the movement of the drawer handle with respect to the drawer body; and an unlocked configuration, in which the detent element is disengaged from the detent region to allow the movement of the drawer handle with respect to the drawer body.

15. The dispensing drawer of claim 14, wherein the detent element comprises a detent hook member and a resilient member, the resilient member exerting a resilient force pushing the detent hook member against the detent region when the drawer handle is connected to the front portion of the drawer body.

* * * * *